US005445391A

United States Patent [19]

Gleason, Jr.

[11] Patent Number: 5,445,391

[45] Date of Patent: Aug. 29, 1995

[54] MULTI-INDICIA PLAYING CARDS

[76] Inventor: Richard F. Gleason, Jr., 67 Stadium Way, Allston, Mass. 02134

[21] Appl. No.: 157,835

[22] Filed: Nov. 24, 1993

Related U.S. Application Data

[63] Continuation-in-part of Ser. No. 770,580, Oct. 3, 1991, Pat. No. 5,280,916.

[51] Int. Cl.[6] ..... A63F 1/04; A63F 3/06

[52] U.S. Cl. ..... 273/304; 273/138 R; 273/139; D21/45

[58] Field of Search ..... 273/303-306, 273/38 R, 139; D21/42-45

[56] References Cited

U.S. PATENT DOCUMENTS

| | | | |
|---|---|---|---|
| D. 169,947 | 6/1953 | Inman | D21/45 |
| D. 212,239 | 9/1968 | Schick | D21/45 |
| 712,566 | 11/1902 | Moller | 273/304 |
| 821,781 | 5/1906 | Cadwallader | 273/304 |
| 1,551,761 | 9/1925 | McCarroll | 273/304 |
| 1,693,525 | 11/1928 | Niederlitz | 273/304 |
| 4,170,358 | 10/1979 | Hancock | 273/304 |
| 4,955,619 | 9/1990 | Christman | 273/273 |
| 5,130,792 | 7/1992 | Tindell et al. | 358/85 |
| 5,280,916 | 1/1994 | Gleason, Jr. | 273/304 |

FOREIGN PATENT DOCUMENTS

| | | | |
|---|---|---|---|
| 261488 | 6/1926 | Canada | 273/304 |
| 23073 | 10/1910 | United Kingdom . | |
| 24658 | 4/1911 | United Kingdom . | |
| 285610 | 2/1928 | United Kingdom | 273/304 |

OTHER PUBLICATIONS

Archer, John, "Liars Poker, A Winning Strategy", 1982, Las Vegas, Nevada.

*Primary Examiner*—Benjamin H. Layno

[57] ABSTRACT

The invention features methods of Liar's Poker play, and apparatus useful for Liar's Poker, including multi-denomination playing cards. In the deck of playing cards, each card includes first and second playing card denominations, and a third value indicia. Each of the first, second, and third indicia for each card are chosen independently of the other two.

8 Claims, 3 Drawing Sheets 12,20
10,18
(53) 02
(57) 07
(64) 01
(61) 46
(56) 50
(104) 24
(87) 10
(66) 28
ACE
TWO
THREE
FIVE
SIX
NINE
KING
FOUR

MULTI-INDICIA PLAYING CARDS

CROSS REFERENCE TO RELATED APPLICATIONS

This application is a continuation-in-part of U.S. application Ser. No. 07/770,580, filed Oct. 3, 1991, now U.S. Pat. No. 5,280,916 incorporated herein by reference.

BACKGROUND OF THE INVENTION

The invention relates to games of chance, and articles for randomly producing combinations of values on which to bet, for instance playing cards.

Double-denomination cards are used, for instance, to speed up card games. A card that is denominated as both the ace of spades and six of clubs can be used as either, to the best advantage of the player holding the card.

The game of Liar's Poker is a contract game. Each player uses the digits of the serial number of a dollar bill as his "hand." In an auction phase, each player bids a combination of digits greater than the previous high bid, either in number or digit value, or passes. An auction may, for instance, proceed with the following bids: one four, two fours, three sixes, three nines, four zeros. When all players but one have passed, all the dollar bills are shown: the high bidder wins if all players' serial number digits combine to satisfy the bid. The players may agree that if the shown serial numbers exactly match the high bid, the high bidder's winnings are doubled.

SUMMARY OF THE INVENTION

The invention features methods of Liar's Poker play, and apparatus useful for Liar's Poker and other games of chance.

In a first aspect, the invention features a method of play including dealing, auction, and exposure steps. Each of a plurality of players are dealt a plurality of playing cards or representations of playing cards, each dealt card having a denomination including a suit and a rank. In the auction, a bid includes a count and a rank, the count of a higher bid being equal to or greater than the count of a lower bid, the rank of a higher bid with the same count as a lower bid being greater than the rank of the lower bid. When the auction is concluded, the dealt cards are exposed to determine whether the number of cards of the last-bid rank held by the players meets or exceeds the last-bid count.

Preferred embodiments may include one or more of the following features. The distinct ranks of the playing card denominations number at least thirteen. Each playing card has two or more denominations. The dealing step includes printing indicia of the dealt cards and auction on a lottery scratch ticket, and the auction step includes revealing a bid by scratching off a scratch panel of the scratch ticket. The auction is a declining-bid auction, wherein a player may bid a lower bid by paying a price greater than a price paid for a higher bid.

A second aspect of the invention provides a deck (or representation of a deck) of playing cards, the face indicia of each card including first and second playing card denominations, and a third value indicia. Each of the first, second, and third indicia for each card are chosen randomly, independent of the other two.

Preferred embodiments of this aspect may include the following features. The third value indicia includes an integer value. The face indicia of each card includes fourth indicia chosen independently of the first, second and third indicia. The third and fourth value indicia form two non-overlapping series of integers. The playing card rank of either the first or second indicia of each card is at least eight.

In a third aspect, the invention features a method of play implemented by a video game computer including deal, auction and display steps. In the deal step, one or more hidden hands of simulated cards are dealt. The auction is a declining-bid auction: the machine offers the player a bid including a count and a card rank, and the player may either accept the bid or insert a coin to obtain a generally-lower bid. In the display step, the hidden hands are displayed to the player. When the total of the tokens in the displayed hands meet or exceed the accepted bid, paying to the player a predetermined pay-off amount.

Preferred embodiments may include the following features. The pay-off amount is determined as each bid is offered to the player, the pay-off amount generally declining with each offered bid. In the deal step, a face-up hand is displayed to the player, the cards of which count toward making the bid. The hidden hands number between one and seven, more preferably four and six, and more preferably five.

In a fourth aspect, the invention features a scratch-off lottery ticket including a plurality of indicia panels each obscured by a removable layer of ink. A first panel provides a bid including a count and a rank, and two or more panels provide tokens each having a rank. The ticket is determined to be a winning ticket if the count of the tokens having a rank matching the rank of the bid meets or exceeds the count of the bid.

Preferred embodiments may include scratch-off panels that summarize the bid and token panels, showing whether the ticket is a winning ticket, or an indicia panel indicating a payoff to be paid if the ticket is determined to be a winning ticket. The ticket may have two or more rows, each row including the bid and two or more token panels, each row determined to be a winning row if the count of the tokens in the row having a rank matching the rank of the bid of the row meets or exceeds the count of the bid of the row.

Embodiments of the invention may provide the following advantages. Dealing a few cards provides enough values to provide an interesting game of Liar's Poker. The cards may be used either as standard single-denomination cards, or as double-denomination cards. The numeric indicia may be used to generate wagers for games of chance, for instance lottery or Keno numbers.

When used as double-denomination cards, the cards of the invention provide the following advantages. A player may choose between the two denominations as a card game progresses. Multiple-denomination cards make the rarest of card combinations from the prior art regular occurrences. Multiple-denomination cards speed play for many games: a hand of gin rummy can be concluded in as few as two to three cards drawn after the deal. Opening a hand of draw poker with at least two pair is common. High value combinations in seven-card stud are so frequent that five-card straights and flushes often lose. A game of cribbage is played in less than half the time it used to take with cards of the prior art.

DESCRIPTION OF PREFERRED EMBODIMENTS

Figures 1A, 1B, 1C, 1D, 1E, 1F, 1G, 1H:
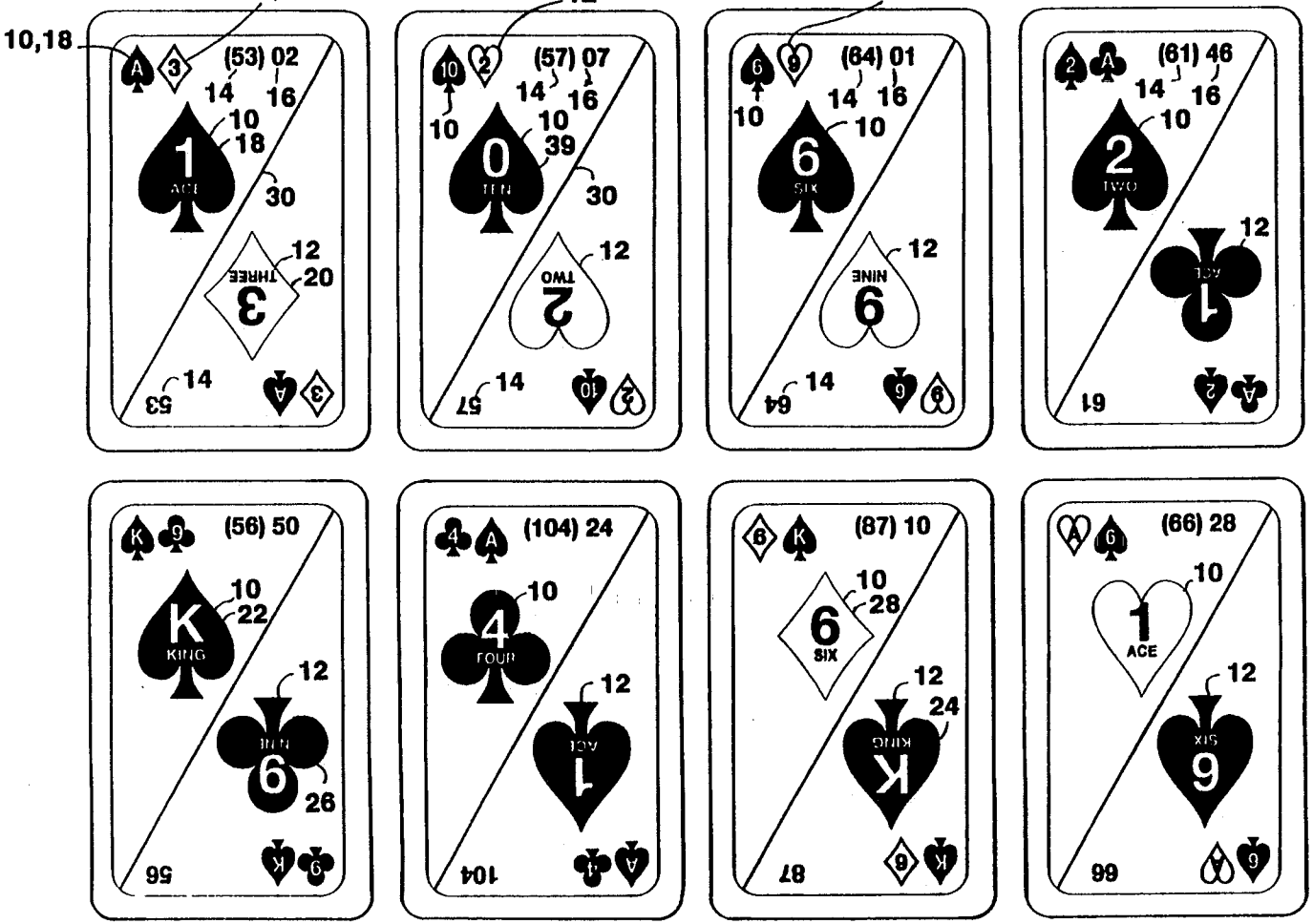
FIGS. 1*a*–1*h* show eight multi-denomination cards of the invention.

FIGS. 1*a*–1*h* show eight example cards from a deck of fifty-two multi-indicia cards. Each card bears two normal playing card denominations 10, 12 and two numbers 14, 16. For example, the card of FIG. 1*a* bears the ace of spades 18 and three of diamonds 20, and the numbers 02 and 53. Preferably, the fifty-two standard card denominations appear once each as the top denomination 10 of a card, and once each as the bottom denomination 12 of another card. The multiple indicia 10, 12, 14, 16 coupled for each card may be chosen to randomize the couplings, though it is desirable that each indicia be chosen without replacement (for instance, for a deck of fifty-two cards, the first card denomination 10 and second card denomination 12 indicia should each provide the full set of fifty-two standard card denominations).

Though the couplings may be chosen randomly, it may be desirable to constrain indicia coupled for each card. For instance, as shown in FIGS. 1*a*–1*h*, the couplings of card indicia may be constrained so that no card couples two card denominations 10, 12 of the same rank or the same suit. Further, it may be desirable to constrain the pairings of card denominations so that no two card denominations are coupled twice within a single deck. For instance, referring to FIGS. 1*e* and 1*g*, the king of spades 22, 24 is coupled once with the nine of clubs 26 and once with the six of diamonds 28, rather than twice with the nine of clubs.

In addition to the two card denominations, each card bears two numeric indica 14, 16. In the embodiment of FIGS. 1*a*–1*h*, the first number 14 is printed in black and lies between 01 and 52, and the second number 16 is printed in red and lies between 53 and 104. The couplings of numbers 14, 16 with card denominations 10, 12 is random, though possibly constrained to eliminate correlated runs between card ranks and numbers, etc. Each card's second number 16 value is printed twice on the card, once in parentheses next to the first number value 14.

The printing on the card may be laid out to distinguish one of the two card denominations as "preferred" so that the multi-denomination deck may be used as a standard single-denomination deck. For instance, in the embodiment of FIGS. 1*a*–1*h*, the top edge has all four indicia shown across the top, where only three are shown across the bottom. The top card denomination may then be chosen as the only useable denomination for single-denomination play. The "preferred" denomination can be noted in other ways, for instance by shading or coloring half of the card, or providing a mark next to the preferred denomination.

The couplings of card indicia may vary from deck to deck. Decks with identical couplings of indicia may be indicated with identical backs. For instance, blue-backed decks may have one set of couplings, and red-backed decks may have another different set.

Each card is the size, shape, and weight of a normal playing card. Common playing card sizes include bridge cards of $2\frac{1}{4}'' \times 3\frac{1}{2}''$, poker cards of $2\frac{1}{4}'' \times 3\frac{1}{2}''$, and miniature cards of $1\frac{3}{4}'' \times 2\frac{1}{2}''$. The division between the two card denomination fields may be a diagonal line 30 as shown in FIG. 1*a*–1*h*, horizontal, or at other angles.

In another embodiment, not shown, each card has at least one card denomination whose rank is at least eight. This increases the inventory of cards bearing a ten, jack, queen, king or ace from twenty in a standard deck to forty. By adding to this deck another four cards that bring the number of eights, nines, tens, jacks, queens, kings and aces to eight each (the exact choice of card denomination for these four cards will depend on the denomination pairings of the fifty-two other multi-denomination cards), a single deck can double as either a pinochle deck or as a standard fifty-two card deck. These four extra cards would be marked with a legend to allow their removal to restore a fifty-two card deck.

Figure 2:
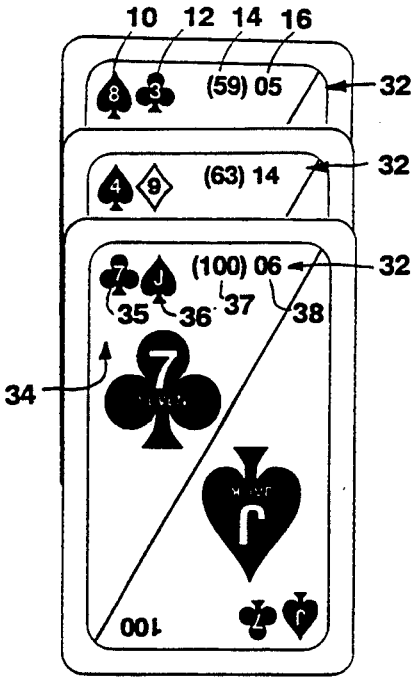
FIG. 2 shows three multi-dimension cards stacked in a hand.

Referring to FIG. 2, the multiple indicia 10, 12, 14, 16 of a single card are preferably noted at an edge of the card, for instance across the top edge 32, so that all indicia of multiple cards can be read simultaneously when the cards are held in an overlapping relationship. The multiple indicia could be arrayed down the left edge 34 of the card, either alternately or additionally, so as to be visible when the cards are held in a fan arrangement.

The cards may be used to play any conventional card game, allowing the player to choose a single denomination for the card as it is played. In other games, for instance Liar's Poker, both card denominations—or all four of the indicia—may be used simultaneously. Referring again to FIG. 2, each card provides six or seven values to form the player's hand. For instance, by considering the two card ranks 35, 36 and the digits of the two number indicia 37, 38 as separate values, the top card of FIG. 2 provides three zeros, one one, one six, one seven, and one jack. By dealing only a small number of cards, for instance two or three, each hand contains enough values to provide an interesting game. In alternate variations, only the two card denominations 10, 12 may be used, or only the card denominations and the black number 14.

The multiple-indicia cards are useful in a number of games of chance. For instance, to pick a number for a four-digit lottery bet, a player may turn successive cards to get four digits (face cards are ignored). Toward this end, the card denomination on cards of rank ten are shown as zero 39, as in FIG. 1*b*.

Alternately, to generate a wager in a Keno game whose numbers go from one to eighty, the cards may be turned one by one. If card is oriented upside-down relative to the orientation of FIGS. 1*a*–1*h*, the top of the card shows only a single number 14 between 53 and 104. If the number is eighty or less, that number is added to the wager. If the card is oriented as shown in FIGS. 1*a*–1*h*, then the unparenthesized number 16 at the top of the card is added to the wager.

The multiple indicia 10, 12, 14, 16 may be used in similar ways for other games of chance, either to determine a wager to bet on or to produce a random value to determine whether a player wins.

Figure 3:
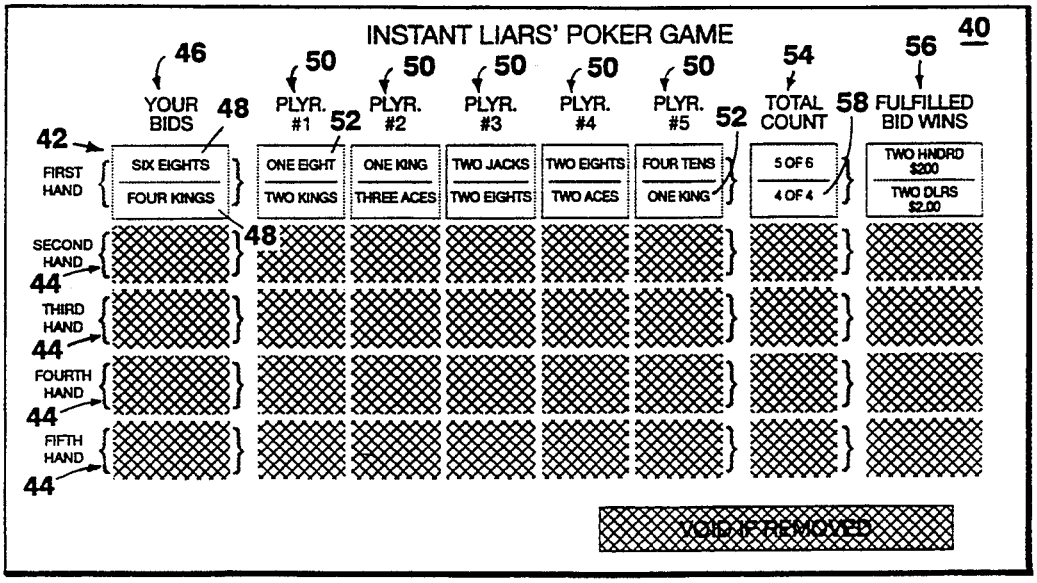
FIG. 3 shows a lottery scratch ticket of the invention.

Referring to FIG. 3, another aspect of the invention uses multi-denomination cards to create an instant scratch-off lottery ticket 40 for Liar's Poker. Each of five horizontal rows 42, 44 of scratch-off panels represents play of a single hand. In each row 42, 44, the first column 46 shows a pair of Liar's Poker bids 48. The next five columns 50 show the five hands 52 of imaginary "players:" each scratch panel shows one or more tokens, for instance playing cards, or as shown, a pair of counts and card ranks. The seventh column 54 summarizes the row's bid and five hands, showing whether each of the two bids 48 from column one 46 is satisfied by the tokens in the five players' hands 52. The eighth column 56 shows the payoff for a satisfied bid. In the example of FIG. 3, the player has scratched off the first row 42: the ticket holder "bids" six eights and four kings. The two subrows of the first row show, respectively, a total of five eights (players one and four) and four kings (players one and five). The last column 56 shows that the satisfied bid 58 of four kings pays two dollars. The ticket purchaser can play five "hands" 42, 44 on a single ticket, each paying off independently.

The described instant lottery ticket 40 retains the instant win/lose features of lottery scratch tickets, while adding suspenseful play that requires the player to scratch off at least five scratch panels, and allows him to scratch off up to forty scratch panels to determine whether the ticket wins and how much. For instance, a player may scratch off each row from left to right, and count up the cards to see whether the imaginary players' hands meet the bid of the left column. Or, a more-hurried player may scratch off only the "total count" column 54 to see if the ticket wins or loses.

Figure 4:
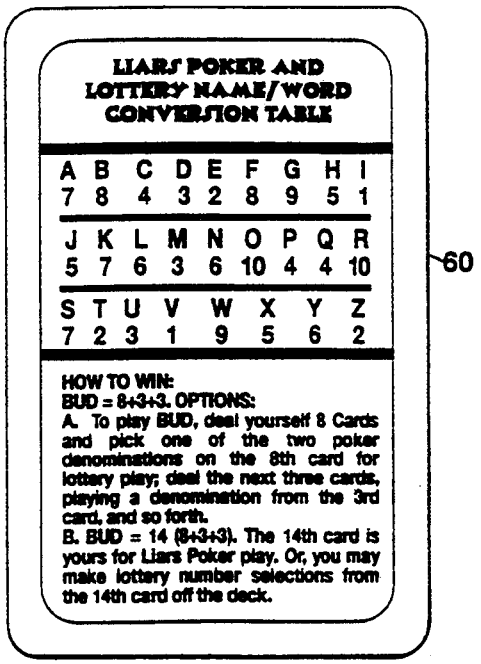
FIG. 4 shows a card with a letter-to-number conversion table.

Referring to FIG. 4, the deck of multi-indicia cards may be supplemented with a letter-to-number conversion card 60. (FIG. 4 is enlarged relative to FIGS. 1*a*–1*h* and 2; the actual card is the same size as the other cards of the deck.) A player chooses a word, for instance his name or nickname, and converts the letters of the word to numbers using the conversion table. The player may then add these numbers together. The number or numbers thus determined may be used, for instance, to choose cards from the deck of multi-indicia cards.

Figure 5:
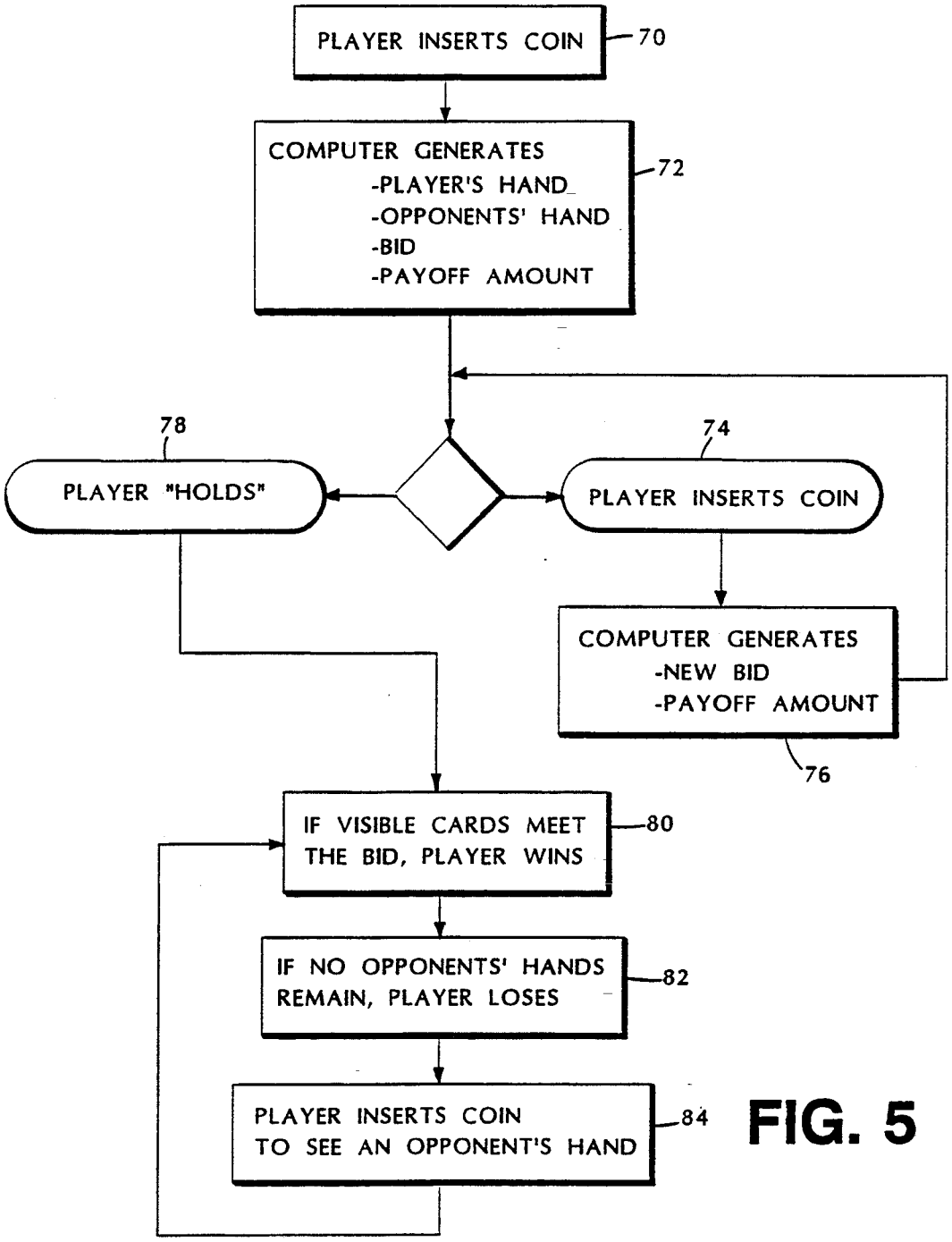
FIG. 5 is a flowchart illustrating play of a video game for liar's poker.

A Liar's Poker gamblings machine may be designed to play as shown in FIG. 5. In step 70, a player inserts a coin to start the game. In step 72, the machine provides the player a face-up hand, several face-down hands, a bid, and a pay-off amount. Typically, the initial bid and odds are both fairly high. If he likes, in steps 74 and 76 the player may insert more coins to bring the bid down, for instance from nine eights to eight kings. Typically the pay-off for this new lower bid will also be reduced. When the bid reaches a level satisfactory to the player, in step 78 the player presses a "hold" button of the machine. In step 84, the player then inserts coins, one at a time, to "buy" the face-down hands toward satisfying his bid. If the "bought" hands satisfy the player's bid, in step 80 the machine pays the pay-off amount. When all hands have been turned, if the bid is not met, in step 82 the player loses. The game is typically most interesting to the player if there are five face-down hands, each containing between about eight and twelve cards, in addition to the face-up hand dealt to the player himself.

What is claimed is:

1. A deck or representation of a deck of playing cards, each of said cards being of generally the same rectangular size and having visually-similar rear faces, the face indicia of each card comprising:

first indicia representative of a standard playing card denomination having a playing card suit and rank, said suit selected from Spade, Heart, Diamond, and Club, the rank selected from 2, 3, 4, 5, 6, 7, 8, 9, 10, Jack, Queen, King, and Ace, the first indicia of each card of said deck being different from the first indicia of all other cards of said deck;

second indicia representative of a standard playing card denomination having a playing card suit and value, said second indicia chosen independently of said first indicia, the second indicia of each card of said deck being different from the second indicia of all other cards of said deck; and a third value indicia, generally varying over the cards of said deck and chosen independently of said first and second indicia of the card with said third value indicia identifying each of the 52 poker card denominations of the first said indicia by a number ranging from 01 to 52 as distinguished from the 52 poker card denominations of said second indicia.

2. The playing card deck of claim 1 wherein said third value indicia comprises an integer value.

3. The playing card deck of claim 2, the face indicia of each card further comprising fourth indicia generally varying over the cards of said deck and chosen independently of said first, second and third indicia of the card.

4. The playing card deck of claim 3 wherein said third and fourth value indicia are two integer values, the integer values of said third indicia for all cards of said deck disjoint from the integer values of said fourth indicia for all cards of said deck.

5. A deck or representation of a deck of playing cards, each of said cards being of generally the same rectangular size and having visually-similar rear faces, the face indicia of each card comprising:

first indicia representative of the suit and rank of a standard playing card denomination;

second indicia chosen independently of said first indicia, the second indicia of each card being different from the first and second indicia of all other cards of said deck.

6. The playing card deck of claim 5 wherein said second indicia comprises an integer value.

7. The playing card deck of claim 6, the face indicia of each card further comprising third indicia chosen independently of said first and second indicia, the third indicia of each card being different from the first, second, and third indicia of all other cards of said deck.

8. The playing card deck of claim 7 wherein said second and third indicia of each card are two integer values, the integer values of said second and third indicia of all cards of the deck being consecutive integers.

* * * * *